US006012620A

United States Patent [19]

Murray

[11] Patent Number: 6,012,620

[45] Date of Patent: Jan. 11, 2000

[54] EXPANDED GARMENT HANGER ATTACHMENT

[76] Inventor: Barbara J. Murray, 4011 Linden Hills Blvd., Minneapolis, Minn. 55410

[21] Appl. No.: 08/827,044

[22] Filed: Mar. 25, 1997

[51] Int. Cl.[7] ..... A47G 25/14

[52] U.S. Cl. ..... 223/98

[58] Field of Search ..... 223/85, 98

[56] References Cited

U.S. PATENT DOCUMENTS

| | | | |
|---|---|---|---|
| 1,893,968 | 1/1933 | Spence | 223/98 |
| 2,320,414 | 6/1943 | Dalloz . | |
| 2,420,101 | 5/1947 | Samann . | |
| 2,524,978 | 10/1950 | Humphreys . | |
| 3,179,315 | 4/1965 | Sieradzki | 223/98 |
| 3,212,687 | 10/1965 | Bradley . | |
| 3,301,447 | 1/1967 | Felton . | |
| 3,347,428 | 10/1967 | Gauthier | 223/98 |
| 3,460,727 | 8/1969 | Baughman | 223/98 |
| 3,537,625 | 11/1970 | Nuttall | 223/85 |
| 3,602,408 | 8/1971 | Gaydos . | |
| 3,680,747 | 8/1972 | Quisling . | |
| 3,733,016 | 5/1973 | Rood . | |
| 3,762,614 | 10/1973 | Musante . | |
| 3,807,609 | 4/1974 | Tymoszek . | |
| 4,658,997 | 4/1987 | Nash | 223/98 |
| 4,981,242 | 1/1991 | Grahm | 223/94 |
| 5,052,599 | 10/1991 | Platti . | |
| 5,056,694 | 10/1991 | Michalik | 223/98 |

FOREIGN PATENT DOCUMENTS

| | | | |
|---|---|---|---|
| 5293029 | 11/1993 | Japan | 223/98 |

OTHER PUBLICATIONS

Photos and Description of Flat Foam Rubber Hanger Attachment.

Photos and Description of Elastic Rubber Band Hanger Attachment.

Halvorson, Donna, "How Retiree–Inventor Shouldered a New Career," Star Tribune, p. E1, Mar. 12, 1996 (Cavles Media, Minn. MN).

*Primary Examiner*—Bibhu Mohanty

*Attorney, Agent, or Firm*—Daniel A. Tysver; Beck & Tysver P.L.L.P.

[57] ABSTRACT

A garment hanger attachment is presented that is formed of a unitary, elongated, flexible body. The body has a partial slit running lengthwise from a point proximal to one end of the body to a point proximal to the other end of the body. In the center of the body, the slit traverses through the entire diameter of the body to allow the hook of the hanger to pass through. The overall shape of the body is formed lengthwise along a single axis, with the slit being molded or cut into the body. The garment hanger attachment is attached to a garment hanger through frictional engagement in the slit or through elastic stretching from one end of the hanger to the other. The attachment is elongated in a straight-line before being attached to the garment hanger, but conforms to the shape of the hanger when attached.

26 Claims, 5 Drawing Sheets

110
100
100
116
120
116
108
7
6
118
100
114
7
106
6
104

EXPANDED GARMENT HANGER ATTACHMENT

BACKGROUND OF THE INVENTION

This invention relates to the field of garment hangers, particularly to hanger attachments designed to provide garment hangers with a wider, non-slip surface on which the garment hangs.

It has long been known that the economical wire garment hanger, while having numerous advantages such as ease of manufacture and low cost, is also burdened by numerous disadvantages. In order to make a wire hanger in a traditional manner, the diameter of the wire must be sufficiently small so as to allow easy manipulation of the wire. Unfortunately, this thin diameter can damage or distort clothing hanging on it. In addition, wire garment hangers are capable of rusting, which also can destroy clothing through staining. Finally, wire hangers generally have a slick surface, which means that clothing may slide off of the hanger.

The recent emergence of plastic garment hangers has reduced these disadvantages to some extent. Standard plastic hangers have a wider diameter than wire hangers, which results in less distortion to the clothing. However, plastic hangers still do not have a diameter that approaches the size of a human shoulder, and therefore still result in clothing distortion. This is particularly true when clothing is left to dry on the hanger. In addition, although plastic hangers do not rust like wire hangers, they do have a similarly slick surface that allows clothing to slide off.

Specialty hangers have been developed that solved the problems relating to wire and plastic hangers. These specialty hangers have a hook, like all hangers, and have wide, padded arms. These arms have a width wider than that of a traditional plastic hanger, to allow the clothing to hang and to dry in a more natural form. The arms are generally padded, such as with a resilient, fabric covered pad. By covering the pads with fabric, or by alternatively forming the pads with a non-slip foam, the arms keep the clothing from sliding off. However, such specialty hangers are created so that the wide, padded arms cannot be removed. Removal is necessary in order to allow the pads to be washed if dirty, changed if damaged, or removed if no longer needed. In addition, specialty hangers tend to be significantly more expensive than standard plastic or wire hangers due to the additional steps required for their manufacture.

What is needed is a replaceable attachment for standard hangers that

- can be used with both plastic and wire hangers;
- creates a wide, rounded shoulder for allowing clothes to hang in a natural shape;
- has a non-slip surface to prevent clothes from sliding;
- is easily attachable and removable; and
- can be constructed simply and inexpensively.

Although there are several designs in the prior art for hanger attachment that meet one or more of these needs, none of the prior art attachments meet all of these needs.

For instance, one known type of hanger attachment is the rigid hanger sheath, exemplified in U.S. Pat. No. 3,301,447 to Felton. In this patent, a sheath of rigid plastic material is made which can snap onto a standard wire hanger. Because the snaps which hold the sheath in place must be of the correct size to hold a wire hanger snugly, a single sheath could not be utilized with both a wire and a plastic hanger. In addition, although the sheath could be inexpensively manufactured through plastic injection molding, the rigidness of the plastic required to form the snaps generally prevents the surface from having a non-slip characteristic. Ridges in the surface of the sheath are known in the prior art, but are inferior to surfaces made entirely of a non-slip material. Also known is the technique of covering of the surface of the sheath with a cushioning material such as sponge rubber. However, this multi-layer design is inherently expensive.

Similar hanger sheaths, such as those in U.S. Pat. No. 3,762,614 to Musante and U.S. Pat. No. 3,807,609 to Tymoszek, also need to be constructed with rigid materials in order to keep their shape. As a result, it is difficult to create a non-slip surface without creating a multi-layer design. While not providing a complete sheath, the clothes hanger attachment in U.S. Pat. No. 3,733,016 to Rood also is made out of a rigid material in order to keep its shape and to snap onto a wire hanger.

An alternative attachment to a clothes hanger is shown in U.S. Pat. No. 3,680,747 to Quisling. In this attachment, an elongated strip of paperboard or plastic is wound about a wire hanger. Unfortunately, the shoulder portion created by this attachment is a flat, albeit wide surface, and consequently does not provide the preferred rounded shoulder.

A rounded shoulder is provided by U.S. Pat. No. 3,212,687 to Bradley through the use of two resilient pad sections, each constructed to hold the pad in the desired shape, and joined together by means of an elastic strip. Unfortunately, the complicated construction of this hanger attachment makes inexpensive manufacturing of the attachment impossible.

U.S. Pat. No. 3,602,408 to Gaydos describes a wire hanger clip designed to be clipped onto one end of a wire hanger to provide wide support for a garment's shoulder. A similar clip must be clipped onto the other end of the wire hanger to provide support for each shoulder. This invention suffers in that it is designed to be held in place frictionally or resiliently, and therefore must be manufactured for a specific width of a hanger—either a wire hanger or a plastic hanger, but not both. Furthermore, this invention suffers in that two separate attachments are necessary for each hanger, allowing the attachments to easily separate from each other.

Another prior art hanger attachment that is used in commercial retail markets is shown in FIG. 1. To form this attachment 10, a thin, rectangular sheet of material such as foam rubber is folded lengthwise and fused together at its two ends 12, 14. A length-wise hole 16 through the middle of the rectangle allows the hook 18 of a wire hanger 20 to pass through. The rounded corners of the hanger 20 abut the attachment 10 where the sides 12, 14 of the attachment 10 are fused together. The main length of the attachment 10 is folded around the shoulder portions of hanger 20, forming padded shoulder portions 22 and 24.

The disadvantage of this attachment 10 is that the shoulder portions 22, 24 that are formed are relatively narrow compared to other attachments and therefore do not adequately shape a garment that is hung on hanger 20. The reason for this is shown in the cross-sectional view of attachment 10 shown in FIG. 2. Because the thin rectangle material that forms the attachment 10 must be folded over the hanger 20, the thickness of the material is limited. If the material forming attachment 10 were thicker, it would become difficult to easily fold the material over the hanger 20 and fuse it together at ends 12, 14.

A final prior art hanger attachment is shown in FIG. 3. In this figure, the attachment 30 is a thin, rubbery layer that is glued or otherwise attached to a flat surface on plastic hanger 32, such as by stretching a rubber-like band between two clips. Unfortunately, this attachment 30 must either be permanently attached, or otherwise cannot easily be used on hangers 32 not specifically designed for the attachment 30.

The present invention overcomes these limitations in the prior art by providing a hanger attachment that can be used with both plastic and wire hangers; creates a wide, rounded shoulder for allowing clothes to hang in a natural shape; has a non-slip surface to prevent clothes from sliding; is easily attachable and removable; and can be constructed simply and easily.

SUMMARY OF THE INVENTION

The hanger attachment of the present invention is able to overcome the disadvantages of the prior art by being formed of a unitary, elongated, flexible body. The body is preferably of a uniform cross section, and has a partial slit running lengthwise from a point proximal to one end of the body to a point proximal to the other end of the body. In the center of the body, the slit traverses through the entire diameter of the body to allow the hook of the hanger to pass through.

The overall shape of the body is formed length-wise along a single axis, with the slit being molded or cut into the body. The attachment is attached to the hanger through frictional engagement in the slit or through elastic stretching from one end of the hanger to the other. The attachment conforms to the shape of the hanger when attached.

DETAILED DESCRIPTION OF THE INVENTION

Figure 4:
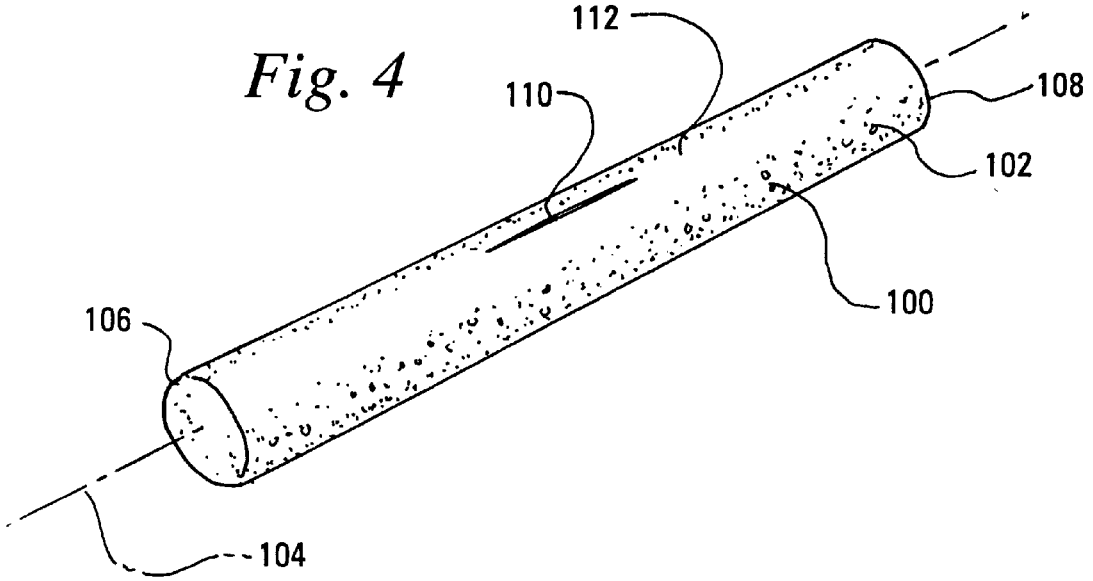
FIG. 4 is a perspective view showing the top portion of a hanger attachment of the present invention.

FIG. 4 shows a hanger attachment 100 of the preferred embodiment of the present invention. The hanger attachment 100 is in the shape of a cylinder 102 formed around axis or center-line 104. Attachment 100 has a first end 106 at one end of the cylinder 102 and a second end 108 at the other end of the cylinder 102. Approximately equal distant between the first end 106 and the second end 108 is a through-slit or hole 110 traversing diametrically through the cylinder 102 from a top portion 112 of the attachment 100 to a bottom portion 114 (not shown in FIG. 4). The width-wise direction of through-slit 110 runs parallel to axis 104.

Figures 5, 6, 7:
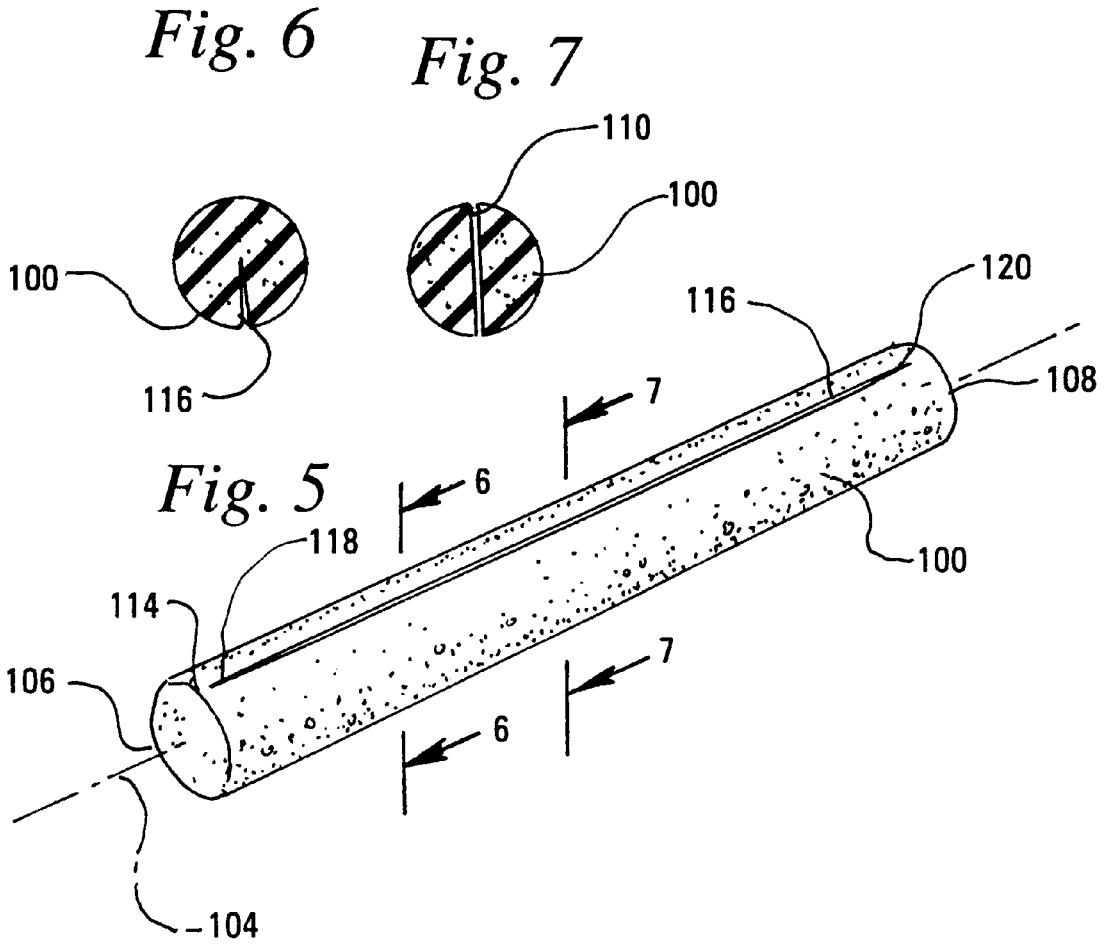
FIG. 5 is a perspective view showing the bottom portion of the hanger attachment of FIG. 4.
FIG. 6 is a sectional view of the hanger attachment of FIG. 5 along line 6—6.
FIG. 7 is a sectional view of the hanger attachment of FIG. 5 along line 7—7.

FIG. 5 shows the bottom portion 114 of hanger attachment 100. A half-slit 116 runs parallel to the axis 104 from a first end-point 118 proximal to first end 106 to a second end-point 120 proximal to second end 108. The half-slit 116 does not pass through the attachment 100, but stops approximately half-way through attachment 100. This is shown clearly in FIG. 6, a cross-sectional view of hanger attachment 100 along line 6—6.

The through-slit 110 is formed by continuing the half-slit 116 all the way through the diameter of the attachment 100. FIG. 7 shows the through-slit in a cross-section view along line 7—7.

Figure 1:
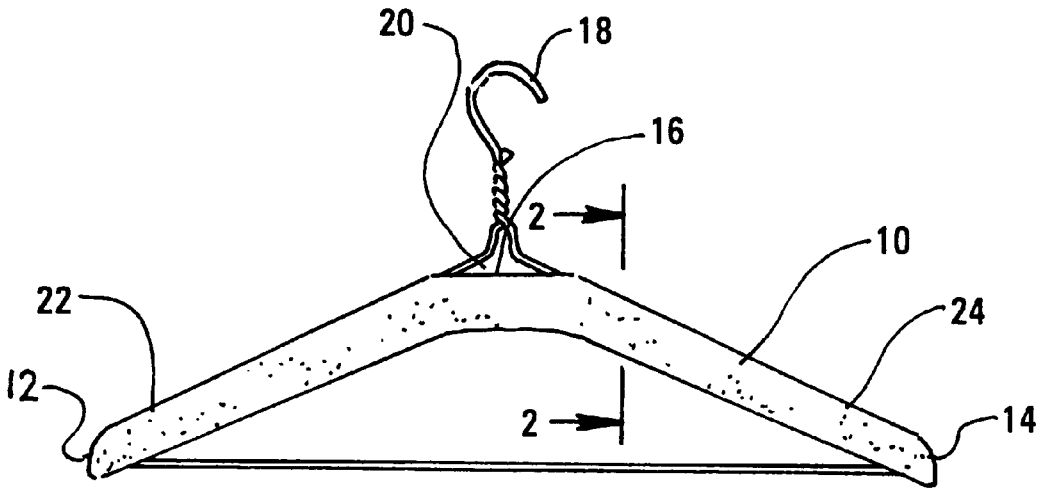
Fig. 1 PRIOR ART
FIG. 1 is a side view of a first prior art hanger attachment.
Figure 2:
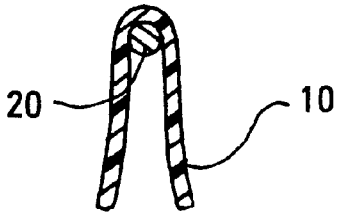
Fig. 2 PRIOR ART
FIG. 2 is a sectional view of the first prior art hanger attachment of FIG. 1 along line 2—2.
Figure 3:
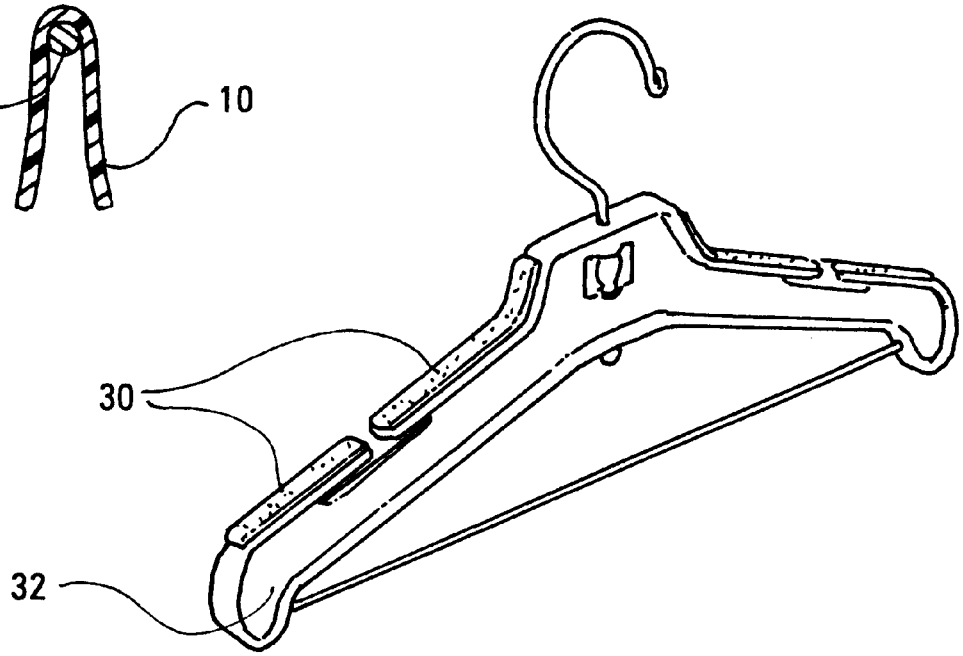
Fig. 3 PRIOR ART
FIG. 3 is a perspective view of a second prior art hanger attachment.
Figure 8:
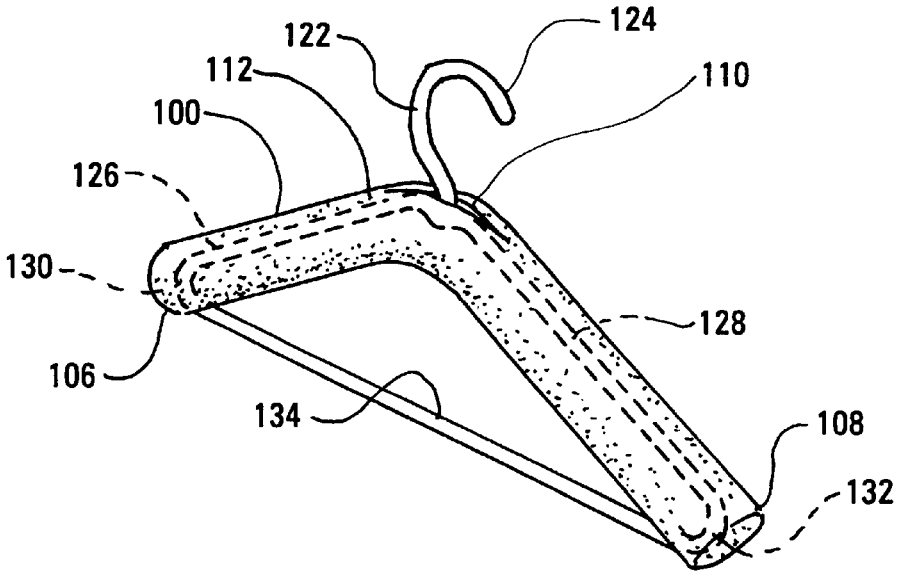
FIG. 8 is a perspective view of the hanger attachment of FIG. 4 with a hanger inserted therein.

FIG. 8 shows the hanger attachment 100 being utilized on a hanger 122 having a traditional hook 124. Two sloping shoulders 126, 128 of hanger 122 run from the hook 124 downward, terminating in two rounded corners 130, 132, respectively. A crossbar 134 runs between corners 130 and 132 and completes the hanger 122.

The hanger attachment 100 is utilized with hanger 122 by passing the hook 124 of hanger 122 through the through-slit 110 so that the hook emerges on the top portion 112 of attachment 100. Although the through-slit 110 can be made as wide as the hook 124 (as is shown in FIG. 8), it is only necessary for the hole 110 to be large enough for the circumference of the hook 124 to fit through. The two sloping shoulders 126, 128 are inserted into half-slit 116. The ends 106, 108 of the hanger attachment 100 are then pushed down over the sloping shoulders 126, 128 until the rounded corners 130, 132 are at least partially within the half-slit 116.

When properly connected, the hanger attachment 100 conforms generally to the shape of the hanger 122. The attachment 100 slopes downward from the through-slit 110 at a slope generally parallel to the sloping shoulder portions 126, 128 of the hanger 122 itself.

The hanger attachment 100 is held in place by either or both of two mechanisms. In the first mechanism, the sides of the half-slit 116 can frictionally engage the sloping shoulders 126, 128 of hanger 122. This is created by selecting a resilient material for the hanger attachment 100. The resiliency of the material, which combined with a narrow half-slit, forces the sides of the half-slit 116 against the sloping shoulders 126, 128 and thereby holds the attachment 100 in place. By careful selection of the material, the half-slit 116 can frictionally engage a plastic hanger or a wire hanger without alteration. The frictional engagement is further assisted by the presence of the hanger hook 124 in the through-slit 110. This engagement helps prevent the attachment 100 from being dislodged from the hanger 122 when accidentally dropped or struck. In the second mechanism, the length of the half-slit 116 is carefully selected so that when the attachment 100 is placed on the hanger 122, the endpoints 118, 120 of the half-slit 116 abut the two rounded corners 130, 132 of the hanger 122. By having the endpoints 118, 120 stretched over the rounded corners 130, 132 in this manner, the resiliency of the attachment 100 keeps the attachment 100 on the hanger 122.

The preferred, resilient material for the hanger attachment 100 is polyurethane foam, specifically flexible polyurethane foam. Such foam is sufficiently resilient to allow the attachment 100 to be secured to the hanger 122, and yet has a non-slip type of surface that will prevent clothes from slipping off of the hanger. Polyurethane foam is commonly available in densities ranging from 0.9 pounds per cubic foot to 3.5 pounds per cubic foot. The preferred embodiment utilizes a colorfast polyurethane foam having a density of 1.45 pounds per cubic foot.

Although flexible polyurethane foam is preferred, any foam material with the same general characteristics could be utilized. It would even be possible to create the hanger attachment 100 utilizing a foam that lacks a non-slip surface, although such a material would not be preferred.

The hanger attachment 100 can be formed from the selected foam material through one of two different types of processes. The first process, which is preferred, involves starting with "slabstock foam," meaning the foam is premanufactured into a variety of stock sizes and densities. A slabstock foam of appropriate size and density is selected and then cut into the desired exterior length, circumference, and cross-sectional shape. While a generally uniform cross-sectional shape is preferred for ease of manufacturing and cost, the foam could be cut so that the cross-sectional shape of the attachment 100 varies. Next, the half-slit 116 and the through-slit 110 are cut into the hanger attachment 100.

The second process is through molding the foam into the desired shape for the hanger attachment. To accomplish this, a mold having the desired length and cross-sectional shape would be created. The mold ideally would also have the half-slit 116 and the through-slit 110 as well, although these slits could be cut in after the molding process is completed. The foam material is then placed into the mold and cured according the techniques appropriate for the selected foam material, as is well-known in the prior art.

Figure 10:
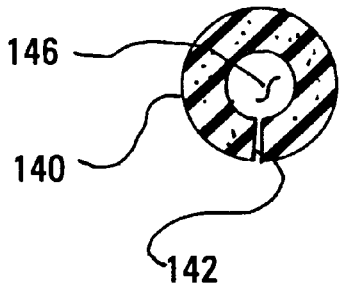
FIG. 10 is a sectional view of the first alternative embodiment of the hanger attachment of FIG. 9 along line 10—10.
Figure 11:
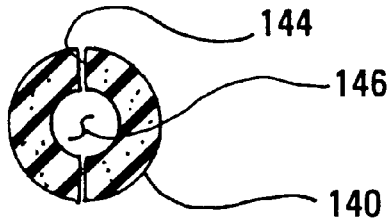
FIG. 11 is a sectional view of the first alternative embodiment of the hanger attachment of FIG. 9 along line 11—11.
Figure 9:
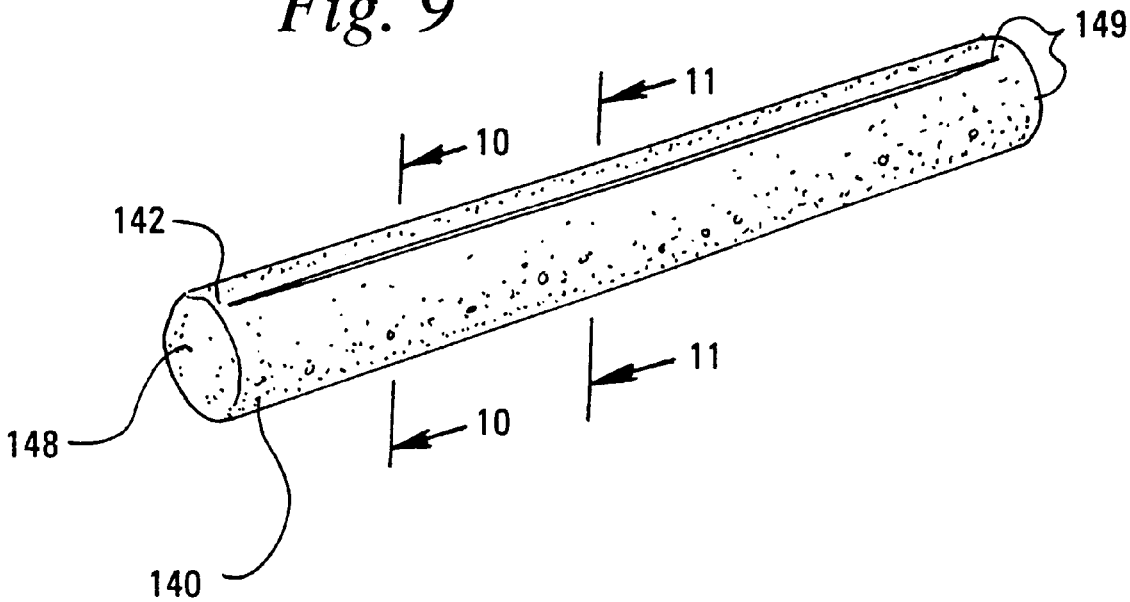
FIG. 9 is a perspective view showing the bottom portion of a first alternative embodiment of a hanger attachment of the present invention.

A first alternative embodiment of a hanger attachment 140 is shown in perspective view in FIG. 9 and cross-sectionally in FIGS. 10 and 11. FIG. 10 shows a cross-section of that portion of the hanger attachment having only a half-slit 142, while FIG. 11 shows a cross-section of that portion of the hanger attachment having through-slit 144. In both figures, an interior hollow 146 is shown. This hollow 146 is sized to approximate the cross-sectional size of a standard plastic hanger (not shown). By including hollow 146, the hanger attachment 140 can utilize a denser foam material than that utilized in the embodiment shown in FIG. 5, since a plastic hanger would not require such a large deformation in the hanger attachment 140. However, the inclusion of hollow 146 makes the hanger attachment 140 less useful in connection with wire hangers, since the wire hanger would not fill the hollow 146. Hence, the wire hanger would be free to move relative to the hanger attachment 140 inside hollow 146, which is not advantageous. On the exterior, the first alternative embodiment shown FIG. 9 can be created to look substantially identical to the embodiment shown in FIG. 5.

The first alternative embodiment of FIG. 9 can be created with the hollow 146 extending all the way through ends 148, 149 of attachment 140. In FIG. 9, attachment 140 is shown with ends 148, 149 sealed.

The construction of the first alternative embodiment of FIG. 9 is accomplished in a similar manner as the embodiment of FIGS. 4–8. In the molding process, the mold can provide for the hollow 146. In the cutting process, the hollow 146 can be drilled into the slabstock foam, either during the creation of the half slit 142 or in a separate step. If the hollow 146 extends through ends 148, 149, no additional work needs to be accomplished. If the ends 148, 149 are to be sealed, they can be sealed via epoxy, melting, or any other of the well-known processes in the prior art.

Figure 12:
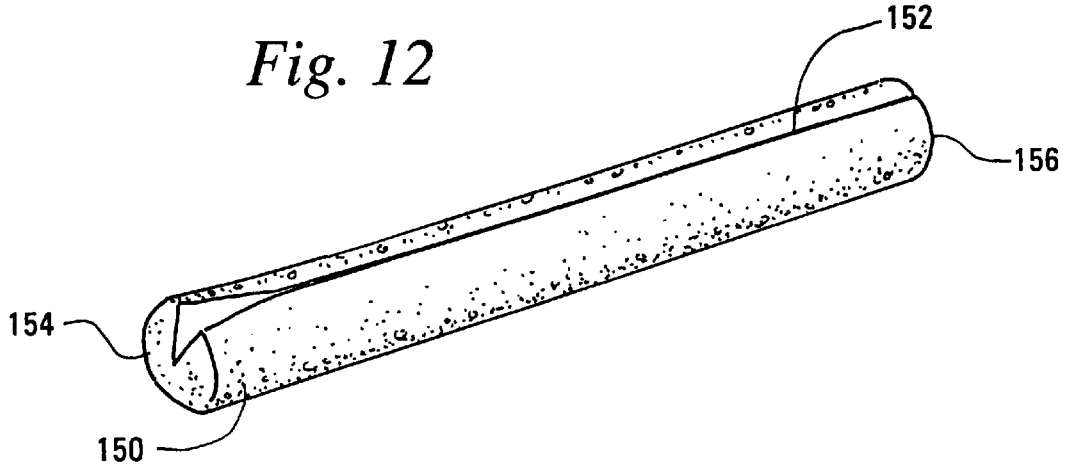
FIG. 12 is a perspective view showing the bottom portion of a second alternative embodiment of a hanger attachment of the present invention.

A second alternative embodiment for the invention is shown in FIG. 12. In this embodiment, the hanger attachment 150 has a half-slit 152 that runs completely from a first end 154 of the hanger attachment 150 to a second end 156. In this embodiment, there are no endpoints of the half-slit 152 that can be placed over the rounded corners of a hanger. As a result, the only mechanism for keeping the attachment 150 on a hanger is the sides of the half-slit 152 frictionally engaging the hanger.

Figure 13:
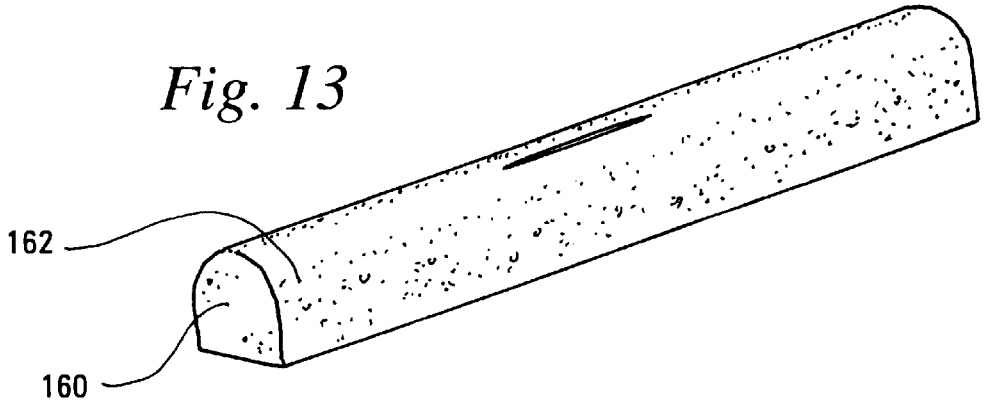
FIG. 13 is a perspective view showing the top portion of a third alternative embodiment of a hanger attachment of the present invention.

A third alternative embodiment, hanger attachment 160, is shown in FIG. 13. As can be seen from this figure, it is not necessary that the attachment 160 be circular in cross-section, although it is preferred that the top portion 162 be rounded in order to prevent creasing in clothing.

The invention is not to be taken as limited to all of the details thereof as modifications and variations thereof may be made without departing from the spirit or scope of the invention. For instance, although the hanger attachments shown in the figures all have a uniform cross-section, it would be obvious to one skilled in the art to create an attachment with a nonuniform cross-section. Additionally, although the preferred embodiment of the attachment is manufactured with a resilient foam such as polyurethane foam, it would be obvious to make the attachment of the invented design of any material having the resilient properties of such foam. Finally, it is possible to form only a portion of the attachment out of the resilient foam. For instance, it is possible to incorporate rigid elements into the attachment, or to cover the foam with a fabric cover.

What is claimed is:

1. A combination garment hanger and attachment comprising:

a) a garment hanger having a pair of sloping arms with an arm to arm length running from a lower end of the first sloping arm up the first sloping arm, and down the second sloping arm to a lower end of the second sloping arm;

b) an attachment having i) a body elongated in a first direction made at least partially of a resilient material, the body having a first and second end, and a top and bottom portion;

ii) a half-slit adapted for receiving the pair of sloping arms, the half-slit running in the first direction and extending partially into the bottom portion of the body, the half-slit extending for a half-slit length longer than the arm to arm length;

iii) the body surrounding the half-slit having sufficient resiliency perpendicular to the first direction to hold the elongated body in place around the hanger arms without requiring that the body be stretched in the first direction to hold the body in place around the hanger; and iv) a through-hole extending from the top portion of the body into the half-slit, the through-hole located approximately equidistant from the first and second ends.

2. The attachment of claim 1, wherein the resilient material is a resilient foam.

3. The attachment of claim 2, wherein the resilient foam is polyurethane foam.

4. The attachment of claim 1, wherein the half-slit extends through the first and second ends of the body.

5. The attachment of claim 1, wherein the half-slit extends from a first end-point near the first end to a second end-point near the second end.

6. The attachment of claim 5, wherein the first and second endpoints are positioned so as to require a slight stretching of the resilient material in the body for the body to be attached to the garment hanger.

7. The attachment of claim 1, further comprising an area forming a hollow running lengthwise through the body, wherein the half-slit extends into the area forming the hollow.

8. The attachment of claim 7, wherein the area forming the hollow extends through the first and second ends of the body.

9. The attachment of claim 1, wherein the body is elongated along a straight line before being attached to the garment hanger, and conforms to the garment hanger when attached.

10. The attachment of claim 9, wherein the body has a uniform cross-section.

11. The attachment of claim 10, wherein the body has a cylindrical shape before being attached to the garment hanger.

12. The attachment of claim 1, wherein the body is formed by cutting a resilient foam into an elongated shape.

13. The attachment of claim 12, wherein the half-slit is formed by cutting the half-slit into the shaped resilient foam.

14. The attachment of claim 13, wherein the through-hole is formed by cutting the through-hole between a top portion of the shaped resilient foam and the half-slit.

15. The attachment of claim 1, wherein the body is formed by molding resilient foam in an elongated mold.

16. The attachment of claim 15, wherein the half-slit and the through-hole are cut into the body.

17. A method for manufacturing a garment hanger attachment comprising:

a) cutting an elongated body having a center, and a first and second end from a prefabricated slab of resilient foam;

b) cutting partway into the elongated body a length-wise running half-slit extending through the first end and the second end of the body; and c) cutting near the center of the elongated body a through-hole that runs from an exterior surface of the body to the half-slit.

18. The method of claim 17, wherein the step of cutting an elongated body further comprises cutting the elongated body into the shape of a cylinder.

19. The method of claim 17, wherein the resilient foam is polyurethane foam.

20. The garment hanger attachment produced according to the process of claim 17.

21. A combination garment hanger and garment hanger attachment for providing a wider support from which clothing may hang on a garment hanger comprising:

a garment hanger having a hook and two sloping shoulder portions with each shoulder portion having a lower end, the garment hanger having a end-to-end length running from the lower end of the first sloping shoulder portion to the hook and down to the lower end of the second sloping shoulder portion;

b) a garment hanger attachment having i) an elongated unitary body formed from one piece of material, the unitary body having a first and a second end, and a middle portion extending approximately from the first end to the second end, the middle portion having an exterior cross-section substantially wider than the hanger;

ii) a downward facing slit in the middle portion extending from a first end-point located proximal to the first end to a second end-point located proximal to the second end, the distance from the first end-point to the second end point being longer than the end-to-end distance of the garment hanger such that when the sloping shoulder portions of the garment hanger are inserted into the slit, the body has a sufficiently wide cross-section and the slit is sufficiently narrow so as to frictionally hold the sloping shoulder portions of the garment hanger in place when the hanger is inserted without requiring that the body be stretched in a longitudinal direction to hold the body in place on the hanger; and iii) an area forming a hole approximately equidistant from the first and second ends extending from the slit to a top surface of the body, such that the hanger hook can be inserted into the hole when the sloping shoulder portions of the garment hanger are inserted into the slit.

22. The garment hanger attachment of claim 21, wherein the exterior cross-section of the middle portion is circular.

23. The garment hanger attachment of claim 21, wherein the unitary body is elongated along a straight line from the first end to a second end before the hanger is inserted into the attachment.

24. The garment hanger attachment of claim 21, wherein the first end-point will abut the lower end of one of the hanger shoulder portions, and the second end-point will abut the lower end of the other hanger shoulder portions after slightly stretching the garment hanger attachment.

25. The attachment of claim 1, wherein the resiliency of the half-slit perpendicular to the first direction is created by utilizing a resilient body have a cross-sectional diameter sufficient to create the necessary resiliency.

26. An attachment for a garment hanger comprising:

a) an elongated body made at least partially of a resilient material, the body having a first and second end, and a top and bottom portion;

b) a half-slit extending partially into the resilient material of the body running lengthwise along the bottom portion of the body, the half-slit extending through the first and second ends of the body;

c) a through-slit extending from the top portion of the body into the half-slit, the through-slit located approximately equidistant from the first and second ends.

* * * * *